US007839066B2

(12) United States Patent
Hrubowchak et al.

(10) Patent No.: US 7,839,066 B2
(45) Date of Patent: Nov. 23, 2010

(54) STRENGTHENED ARC DISCHARGE LAMP

(75) Inventors: David Hrubowchak, Litchfield, NH (US); Graham Wark, Stratham, NH (US); Steven Collins, Lowell, MA (US); Paul Oberlies, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 1514 days.

(21) Appl. No.: 11/036,656

(22) Filed: Jan. 14, 2005

(65) Prior Publication Data

US 2006/0158083 A1 Jul. 20, 2006

(51) Int. Cl.
*H01J 5/48* (2006.01)

(52) U.S. Cl. ..... 313/238; 313/285

(58) Field of Classification Search ..... 313/238–239, 313/292, 49–50, 17, 285
See application file for complete search history.

(56) References Cited

U.S. PATENT DOCUMENTS 2,768,624 A 10/1956 Lamb
4,580,989 A * 4/1986 Fohl et al. ..... 445/26
4,791,334 A 12/1988 Keefe
5,136,204 A * 8/1992 Muzeroll et al. ..... 313/25
6,153,968 A 11/2000 Dombrowski
6,198,223 B1 3/2001 Scholz

FOREIGN PATENT DOCUMENTS

JP 200236503 7/2004

* cited by examiner

*Primary Examiner*—Karabi Guharay
(74) *Attorney, Agent, or Firm*—William H. McNeill

(57) ABSTRACT

A discharge lamp has an axis with an arc tube having a hollow body containing an axially aligned arc generating and sustaining medium. The lamp electrodes and hollow body are arrayed along the axis. A sealed shroud surrounds the arc tube. The shroud and arc tube form an arc tube assembly. An envelope surrounds the arc tube assembly, and includes a base portion with a cylindrical part. Electrical lead-ins extend through the base portion and mechanically and electrically connect to the electrodes. A strengthening member for preventing the arc tube assembly from axial displacement as a result of forces applied substantially normal to the axis is provided. The strengthening member comprises an elongated element having first and second ends. The first end is formed to substantially engage the arc tube assembly, near an upper end, and the second end is formed to substantially engage the base portion.

4 Claims, 2 Drawing Sheets

STRENGTHENED ARC DISCHARGE LAMP

TECHNICAL FIELD

This invention relates to arc discharge lamps and more particularly to such lamps including strengthening members for supporting an arc tube assembly.

BACKGROUND

Arc discharge lamps are noted for their color rendition and relatively long life. In today's common practice, the arc tube itself is often a ceramic vessel enclosed in a glass shroud to contain shards in the event of a non-passive failure. The shroud provides additional benefits such as UV absorbtion. While the shroud is desirable because of these benefits it does introduce problems in even the smaller wattages of the bulb because of the introduction of additional mass. Since the shroud and its enclosed arc tube (herein, an arc tube assembly) are typically mounted from only one end of the lamp, the additional mass creates a problem during shipping. To provide for adequate delivery protection these lamps are subjected to drop-tests, which among other types of testing, involves the application of a force that is substantially normal to the longitudinal axis of the lamp. The application of such a force can cause movement of the arc tube assembly away from its desired alignment along the longitudinal axis of the lamp and, in severe cases can shatter or crack the arc tube or impair its electrical function by breaking one or more of the connections to the electrical lead-ins, which lead-ins also provide mechanical support for the arc tube.

DISCLOSURE OF THE INVENTION

It is, therefore, an object of this invention to obviate the disadvantages of the prior art.

It is another object of the invention to enhance arc discharge lamps.

Still another object to the invention is achievement of the above objects in an economical manner.

These objects are accomplished, in one aspect of the invention, by the provision of an arc discharge lamp having a longitudinal axis and comprising: an arc tube having a hollow body containing an arc generating and sustaining medium; electrodes extending into said hollow body, one from each end of said arc tube, said electrodes and said hollow body being arrayed along said longitudinal axis; a sealed shroud surrounding said arc tube, said shroud and said arc tube forming an arc tube assembly; a lamp envelope surrounding said arc tube assembly, said envelope including a base portion including at least one cylindrical part; electrical lead-ins extending through said base portion and mechanically and electrically connected to said arc tube electrodes; and a strengthening member for preventing said arc tube assembly from displacement from said longitudinal axis as a result of forces applied in a direction substantially normal to said axis, said strengthening member comprising: an elongated element having first and second ends; said first end formed to substantially engage said arc tube assembly; and said second end formed to substantially engage said base portion of said arc lamp.

The strengthening member extending from the base of the lamp to a position near the top of the arc tube assembly restrains the arc tube assembly from deleterious movement during the application of a sudden force in a direction normal to the longitudinal axis. In an additional embodiment of the invention the strengthening member can also be affixed to one of the lead-ins.

BEST MODE FOR CARRYING OUT THE INVENTON

For a better understanding of the present invention, together with other and further objects, advantages and capabilities thereof, reference is made to the following disclosure and appended claims taken in conjunction with the above-described drawings.

Figure 1:
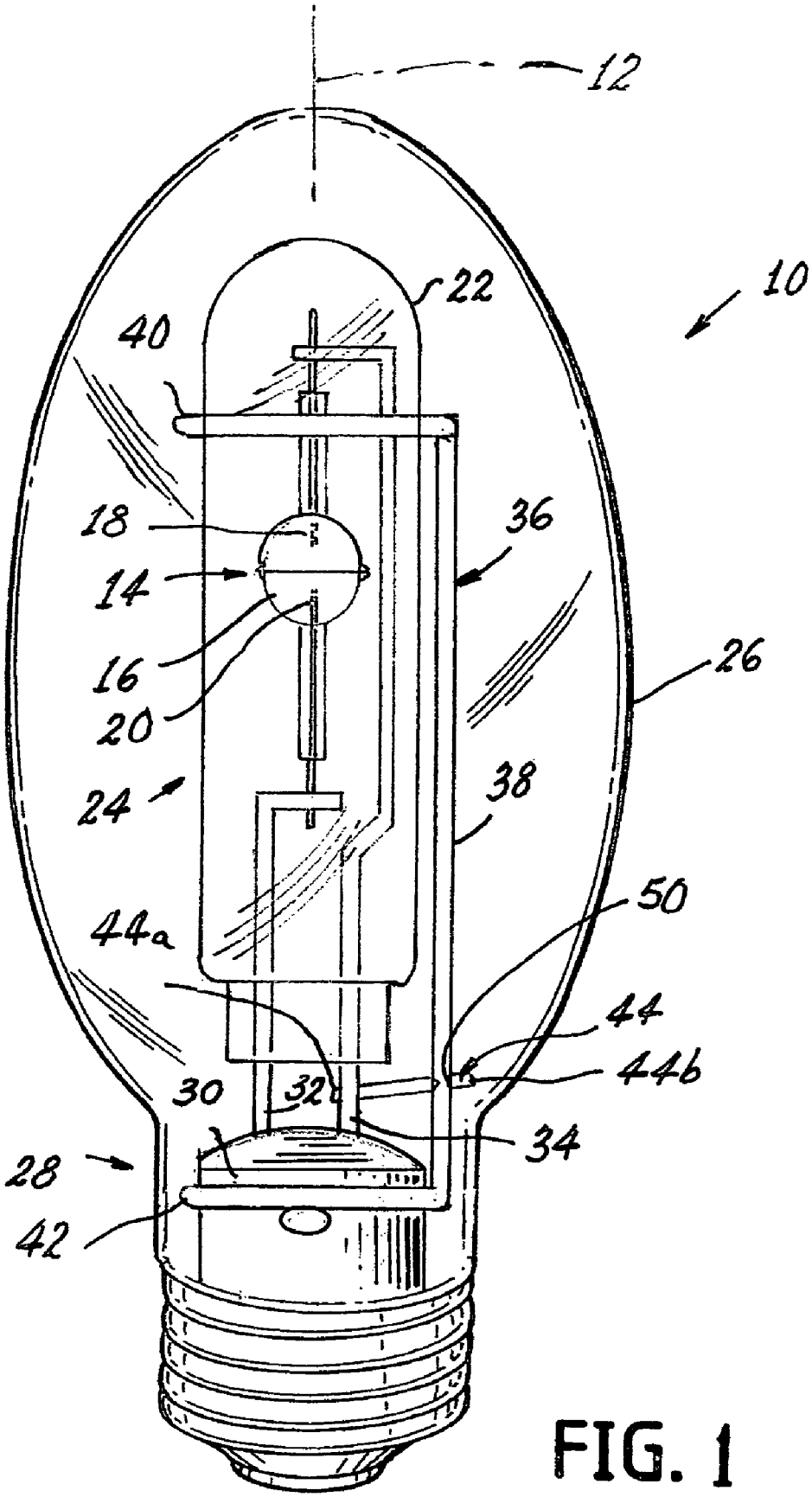
FIG. 1 is an elevational view of an arc discharge lamp employing an embodiment of the invention.
Figure 2:
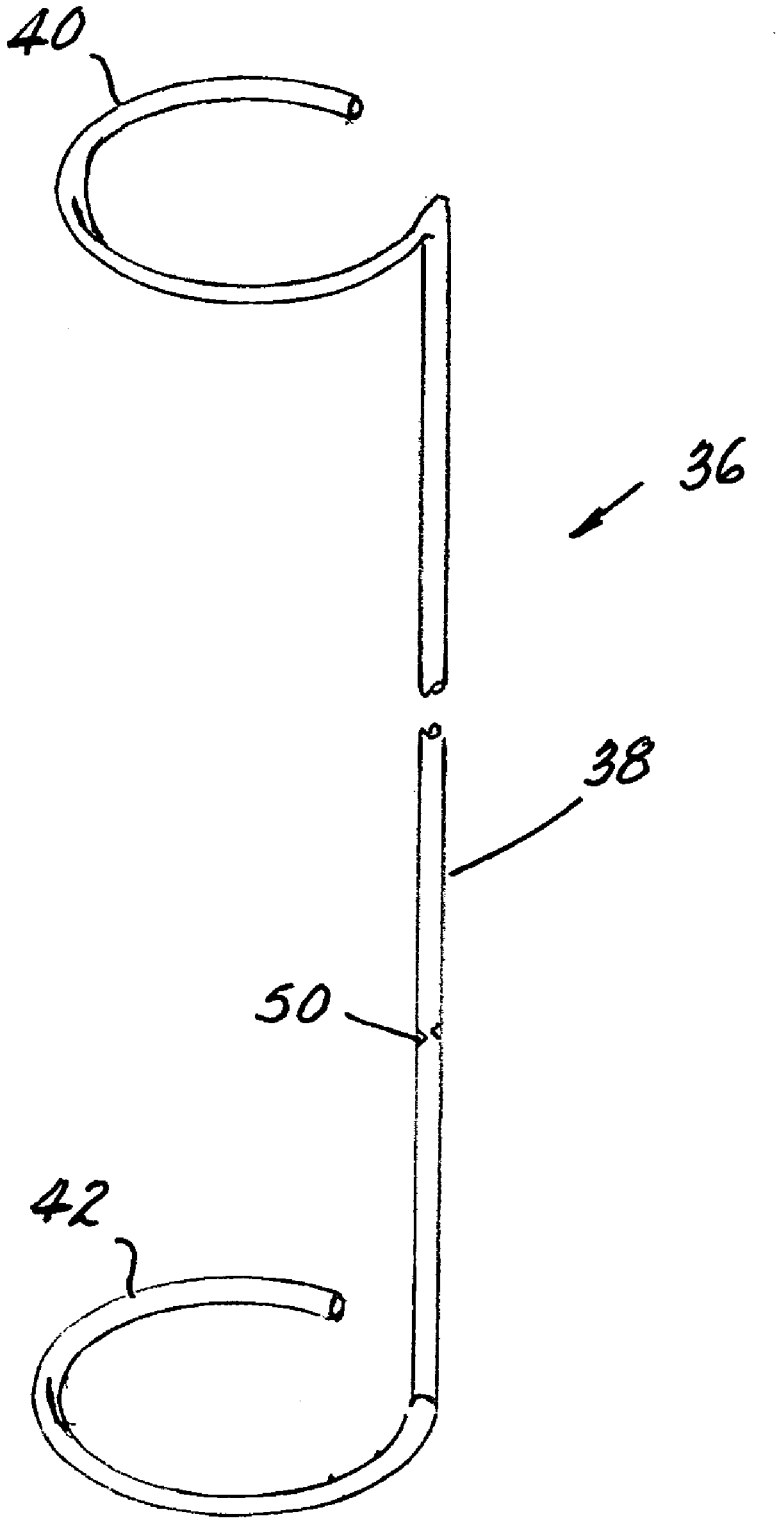
FIG. 2 is a perspective view of the strengthening member alone.

Referring now to the drawings with greater particularity, there is shown in FIG. 1 an arc discharge lamp 10 having a longitudinal axis 12 and with an arc tube 14 having a hollow body 16 containing an arc generating and sustaining medium. The arc tube can be formed of a ceramic material, such as alumina. Electrodes 18 and 20 extend into the hollow body 16, one from each end of the arc tube. The electrodes 18 and 20 and the hollow body 16 are arrayed along the longitudinal axis 12. A sealed shroud 22 surrounds the arc tube and can be evacuated or provided with an inert atmosphere. The shroud 22 and the arc tube 14 form an arc tube assembly 24. In even relatively low wattage examples of such lamps the arc tube assembly can add considerable mass to the lamp. For example, the arc tube assembly for a 39 watt lamp has an approximate mass of 8.5 grams and the assembly for a 70 watt lamp has a mass of about 8.8 grams, more than sufficient to cause the arc tube itself to be moved away from the axis 12 when a force normal to the axis is applied, as is the case during drop testing.

A lamp envelope 26 surrounds the arc tube assembly 24, and the envelope includes a base portion 28 including at least one cylindrical part 30. Electrical lead-ins 32, 34 extend through the base portion 28 and mechanically and electrically connect to the arc tube electrodes 18 and 20, as by welding.

A strengthening member 36 for preventing the arc tube assembly 24 from displacement from the longitudinal axis 12 as a result of forces applied in a direction substantially normal to the axis 12 is provided within the lamp. The strengthening member 36 comprises an elongated element 38 having first and second ends, 40, 42 respectively. The first end 40 is formed to substantially engage the arc tube assembly 24, near its upper end, and the second end 42 is formed to substantially engage the cylindrical base portion 28 of the arc lamp 10.

In a preferred embodiment, the first end 40 and the second end 42 comprises at least a partial circle, in the instance of the first end for sliding over the arc tube assembly 24 and in the instance of the second end for engaging the cylindrical part 30 of the base 28. Preferably, the strengthening member 36 is constructed of stainless steel wire having a diameter of about 1.5 mm and has a bright finish.

A rod 44 preferably has one end 44*a* welded to one of the lead-ins, for example, 34, and a second end 44*b* welded to the elongated element 38 to further strengthen the unit and prevent deleterious displacement from the axis 12. The elongated element 38 can be provided with location dimple 50 to mark the attachment location for the second end 44*b* of the rod 44.

There is thus provided a strengthened arc discharge lamp that has numerous advantages over the prior art. It is economical to fabricate and employ and also aids in automating the manufacture of the entire lamp. The strengthening member 36 is attached to the lamp at only the base thus avoiding the necessity of providing a dimple or some other feature at the top of the envelope, as occasionally been done in the prior art. The latter approach also requires an extension of a support beyond the arc tube or arc tube assembly and interferes with automatic assembly operations.

While there have been shown what are at present considered to be the preferred embodiments of the invention, it will be apparent to those skilled in the art that various changes and modifications can be made herein without departing from the scope of the invention as defined by the appended claims.

What is claimed is:

1. In an arc discharge lamp having a longitudinal axis and comprising:

an arc tube having a hollow body containing an arc generating and sustaining medium;

electrodes extending into said hollow body, one from each end of said arc tube, said electrodes and said hollow body being arrayed along said longitudinal axis;

a sealed shroud surrounding said arc tube, said shroud and said arc tube forming an arc tube assembly; a lamp envelope surrounding said arc tube assembly, said envelope including a base portion having a cylindrical part, a side wall and a top opposite said base portion; electrical lead-ins extending through said base portion and mechanically and electrically connected to said arc tube electrodes; the improvement comprising:

a strengthening member for preventing said arc tube assembly from displacement from said longitudinal axis as a result of forces applied in a direction substantially normal to said axis, said strengthening member being free of contact with said top of said envelope and comprising:

an elongated element having first and second ends;

said first end engaging said sealed shroud of said arc tube assembly and said second end engaging said cylindrical part of said base portion of said arc lamp.

2. The arc discharge lamp of claim 1 wherein said first end of said elongated element is circular with a diameter at least as large as a diameter of said shroud of said arc tube assembl and formed to extend in a direction normal to said elongated element.

3. The arc discharge lamp of claim 2 wherein said second end of said elongated element is circular with a diameter at least as large as a diameter of said cylindrical part of said base portion of said arc lamp and formed to extend in a direction normal to said elongated element.

4. The arc discharge lamp of claim 3 wherein a rod is attached between a lead-in and said elongated element.

* * * * *